US007322289B2

(12) United States Patent
Schneider

(10) Patent No.: US 7,322,289 B2
(45) Date of Patent: Jan. 29, 2008

(54) PRINTING TOWER OPERATING UNIT AND OPERATOR LIFTING DEVICE

(75) Inventor: Raimund Bruno Schneider, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 214 days.

(21) Appl. No.: 10/548,902

(22) PCT Filed: Feb. 16, 2004

(86) PCT No.: PCT/EP2004/050139

§ 371 (c)(1),
(2), (4) Date: Sep. 12, 2005

(87) PCT Pub. No.: WO2004/080718

PCT Pub. Date: Sep. 23, 2004

(65) Prior Publication Data

US 2006/0213383 A1 Sep. 28, 2006

(30) Foreign Application Priority Data

Mar. 14, 2003 (DE) ..... 103 11 284

(51) Int. Cl.
*B41F 5/08* (2006.01)

(52) U.S. Cl. ..... 101/183; 101/181; 101/248; 101/480

(58) Field of Classification Search ..... None
See application file for complete search history.

(56) References Cited

U.S. PATENT DOCUMENTS 4,318,176 A * 3/1982 Stratton et al. ..... 700/125
4,805,111 A * 2/1989 Steidel ..... 700/122
4,839,829 A * 6/1989 Freedman ..... 715/751
5,079,738 A * 1/1992 Bockenfeld ..... 709/252
5,209,159 A 5/1993 Asanuma
5,676,055 A * 10/1997 Schwinn et al. ..... 101/216
5,730,053 A * 3/1998 Tenflede et al. ..... 101/181
5,873,307 A * 2/1999 Tenfelde et al. ..... 101/248
6,167,806 B1 1/2001 Chretinat et al.
6,373,584 B1 * 4/2002 Barney et al. ..... 358/1.15
6,921,220 B2 * 7/2005 Aiyama ..... 400/76

FOREIGN PATENT DOCUMENTS

DE 2741596 A1 3/1978
DE 3225164 A1 4/1983
DE 3225164 C2 1/1991
DE 9215547.2 U1 4/1993
DE 9321349 U1 7/1997
DE 19856675 A1 9/1999
DE 29918654 U1 2/2000
DE 10122179 A1 11/2001
EP 0 160 167 A1 11/1985

* cited by examiner

*Primary Examiner*—Jill E. Culler
(74) *Attorney, Agent, or Firm*—Jones, Tullar & Cooper, P.C.

(57) ABSTRACT

A printing tower includes at least two printing groups which can each be controlled independently of the other by the entry of data into an operating unit. The operating unit is configured independently of the printing groups and can selectively exchange data with different printing groups.

16 Claims, 2 Drawing Sheets

PRINTING TOWER OPERATING UNIT AND OPERATOR LIFTING DEVICE

CROSS-REFERENCE TO RELATED APPLICATIONS

This application is the U.S. national phase, under 35 U.S.C. 371, of PCT/EP 2004/050139, filed Feb. 16, 2004; published as WO 2004/080718 A1 on Sep. 23, 2004 and claiming priority to DE 103 11 284.7, filed Mar. 14, 2003, the disclosures of which are expressly incorporated herein by reference.

FIELD OF THE INVENTION

The present invention is directed to a printing tower with at least two printing groups. The two printing groups are arranged on top of each other. A lifting device is assigned to the printing groups and includes an operating unit.

BACKGROUND OF THE INVENTION

Printing presses are generally known which are in the structural form of printing towers, for example, which printing towers are typically used as rotary printing presses for printing newspapers. Several printing units are provided in these printing presses, so that different colors, or so that both the front and back of a print medium, for example, can be imprinted.

Operating units, by the use of which press operators can control each respective printing unit, are customarily installed in control cabinets, which control cabinets are provided for the individual printing presses for use in operating the individual printing units of each printing press. Customarily, graphic displays or run control boards are provided at these operating units and are used for showing defined parameters of the printing unit. Furthermore, input elements, such as, for example, alpha-numeric keyboards, are usually provided at these operating units for entering control data. So-called touch screens are also being increasingly employed for this purpose.

A disadvantage in connection with known printing presses lies in the large expenditures required for the operating units, since it is necessary to assign a separate operating unit to each individual printing unit. Moreover, the available control cabinet space is reduced by the requirement for operating units at each individual printing unit. The operation of the generally known, customary operating units is also not satisfactory from an ergonomic viewpoint, since the operating units are installed in fixed locations which fixed installations, in particular in connection with wide-format presses, makes more demanding operating steps, which require direct observation at the printing location difficult. Moreover, because of the arrangement and the placement of the operating units in the direct vicinity of the printing units, soiling of the operating units by printing ink often occurs. Also, EMC interferences with the electronic components of the operating units, because of the close proximity of the operating units to the main drive regulators, cannot be ruled out. In the course of removing parts of the printing unit, such as, for example, the ink rollers or the protective device of the inking units, there is also the danger of damage to the operating units which are installed in fixed locations.

DE 32 25 164 C2 discloses a printing press with several printing groups, which printing groups are independently controlled by a remote operating unit. The remote operating unit can selectively exchange data with various printing groups.

A control device for rotary printing presses is known from DE 92 15 547 U1. The printing groups are connected with a control console via a common data bus.

DE 299 18 654 U1 discloses an arrangement for the wireless transmission of signals between a printing press and a mobile computer unit.

DE 93 21 349 U1 shows a transportable operating unit for a printing press, on which operating unit graphic symbols are arranged.

U.S. Pat. No. 5,202,159 describes a printing tower with a lifting device for use by press operators. An operating device, for use in controlling the lifting device, is fastened on this lifting device.

SUMMARY OF THE INVENTION

The object of the present invention is directed to providing a printing tower with at least two printing groups, and in which a simple, cost-effective operation of the at least two printing groups that constitute the printing tower is provided.

In accordance with the present invention, this object is attained by the provision of a lifting device, which is usable for conveying press operators between the at least two printing groups that constitute the printing tower. An operating unit is attached to the lifting device by a support assembly. Several of the printing groups in the printing tower are assigned to this operating unit and each such printing group can be controlled independently of other printing groups by the input of data using the operating unit.

The advantages to be gained by the present invention consist, in particular, in that the operating unit of the printing press is configured to be independent of the several printing groups. In other words, each printing group no longer has its own operating unit. Instead, several printing groups can each be selectively controlled by the use of one operating unit. To accomplish this purpose, the sole operating unit should, as a rule, be arranged in its own housing, since it is independent of the individual structures of the various printing groups. The sole operating unit should be configured in such a way that data can be selectively exchanged with it and the various printing groups.

In a preferred embodiment of the present invention, a selector switch is provided at the operating unit and is usable for selecting a defined printing group from the several printing groups. Because of this configuration, the press operators have the opportunity of selecting a defined printing group by setting the selector switch. Only this defined printing group can now exchange defined types of data with the operating unit. The exchange of such data with other, non-selected printing groups is prevented. In the course of this procedure, it is conceivable, in principle, that, following the selection of a defined printing group, the operating unit can still exchange other types of data with all of the other printing groups. An example of such other types of data, which can be exchanged at all times, with all of the printing groups, regardless of the setting of the selector switch, is an emergency shut-off signal, provided that such an emergency shut-off switch for the entire printing press is provided at the operating unit.

The manner in which data is exchanged between the operating unit and the respective printing group is basically a matter of choice. In accordance with a first embodiment of the invention, suitable connecting cables are provided at each printing group, to which cables the operating unit can be connected for accomplishing a data exchange with the selected printing group.

Alternatively, is also possible to provide a data bus, through which data bus the operating unit can exchange data with the various printing groups.

If a common data bus is not provided, an interface, for accomplishing data transmission, should preferably be provided at each printing group, via which interface, the data between the printing group and the operating unit can be transmitted when the respective printing group is selected. The way in which this interface is constructed is also basically a matter of choice. For example, it is conceivable for this interface to be configured in a wireless manner, and in particular in the manner of an infra-red or a radio interface.

Alternatively to such a wireless interface, it is also possible to provide plug-in connectors for the connection of the operating unit with data cables that connect to the various printing groups.

The selective control of different printing groups, by the use of only a single operating unit, in accordance with the present invention, is particularly advantageous for use with printing presses that are configured with several printing groups arranged one on top of the other. Lifting devices, such as, for example, lifting platforms, for use to convey the press operators to the respectively required level of each printing group, are typically provided in such printing presses, in which several such printing groups are arranged on top of each other. Such a lifting device or platform for a press operator is described in DE 27 41 596 A1, for example.

To attach the operating unit to the lifting device, a support device, such as, for example, a support arm, can preferably be provided. To improve the operating ergonomics, the support device should be configured so that it will permit the vertical and/or horizontal adjustment of the position of the operating unit and/or the inclination of the operating unit. As a result of the provision of such a universal support device, it then becomes possible for the operators to position the operating unit for optimal use, matched to the respective operating steps to be performed, so that for performing an operating step, such as, for example, in the course of observing the print location, it is also possible to input control commands directly at the operating unit. Optimal operation of the operating unit, regardless of the body size of the operator, is also possible because of the provision of such a universal support device.

In a basic form of the present invention, the respective printing group to be controlled by the operating unit is selected by the press operators. If several printing groups are provided in the printing tower, it is possible that errors can occur in the course of this selection by the press operators, so that an incorrectly selected printing group is accidentally triggered by the transmission of data. In the situation in which several printing groups arranged on top of each other, such errors can be avoided if a sensor device, by the use of which the position of the lifting device can be detected, is arranged on the lifting device that is being used for conveying the operators. This sensor device can be configured, for example, in the manner of an electronic cam switching system which may be incorporated in the drive mechanism of the lifting device. Pull cable sensors, open or encapsulated linear measuring systems, and the like can also constitute alternative sensing devices. Information regarding the position or the location of the lifting device is transmitted, by the sensor device, to the operating unit wherein, as a function of the position of the lifting device, data can only be exchanged between defined printing groups and the operating unit, while data exchange with other printing groups is prevented. In other words, this means that by setting the height of the lifting device for example, the operating unit is automatically programmed in such a way that a data exchange between it and the printing tower is possible only with defined printing groups.

The control of defined functions of the printing groups, and in particular, the control of safety-relevant functions, such as the issuance of an emergency shut-off signal, is of particular importance when operating a printing press. Therefore, the operating elements for controlling these defined functions should be provided redundantly at the printing press. This means that such operating elements, for controlling these defined functions, should be provided at the operating unit, as well as at the individual printing groups.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
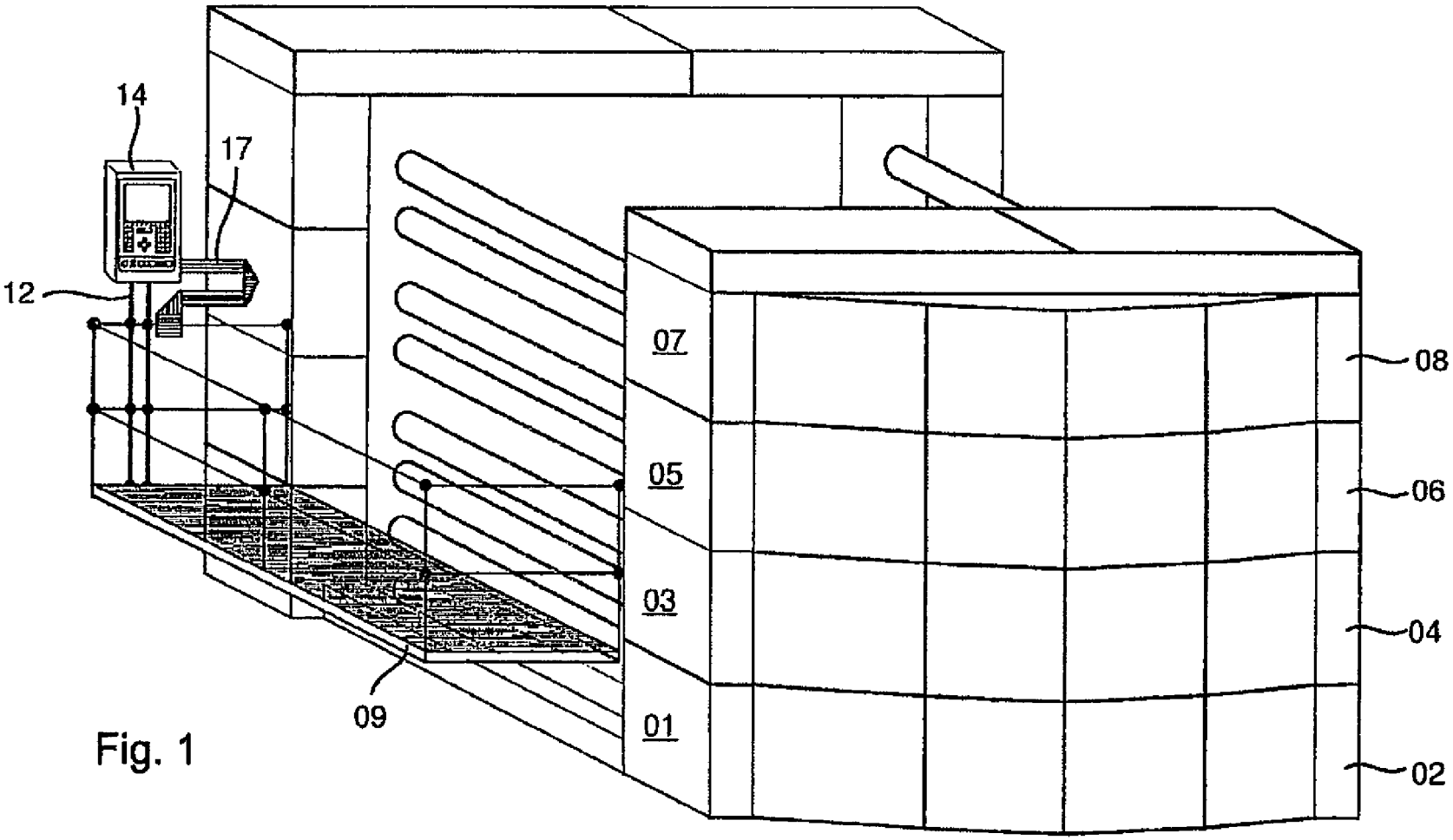
FIG. 1, a perspective plan view of printing press with eight printing groups in accordance with the present invention, and in FIG. 2, a schematic side elevation view of the printing press in accordance with FIG. 1.

Eight printing groups 01 to 08 are provided in the printing press which is represented schematically in FIG. 1. Each one of the eight printing groups 01 to 08 is configured as a rotary printing group. The various components of each the rotary printing groups depicted in FIG. 1 are only schematically indicated. The printing groups 01, 03, 05, 07 are arranged on top of each other on the left side of the printing press. The printing groups 02, 04, 06, 08 are arranged on top of each other on the right side of the printing press. All of the various printing groups 01 to 08 can be operated independently of each other during rotary printing.

Figure 2:
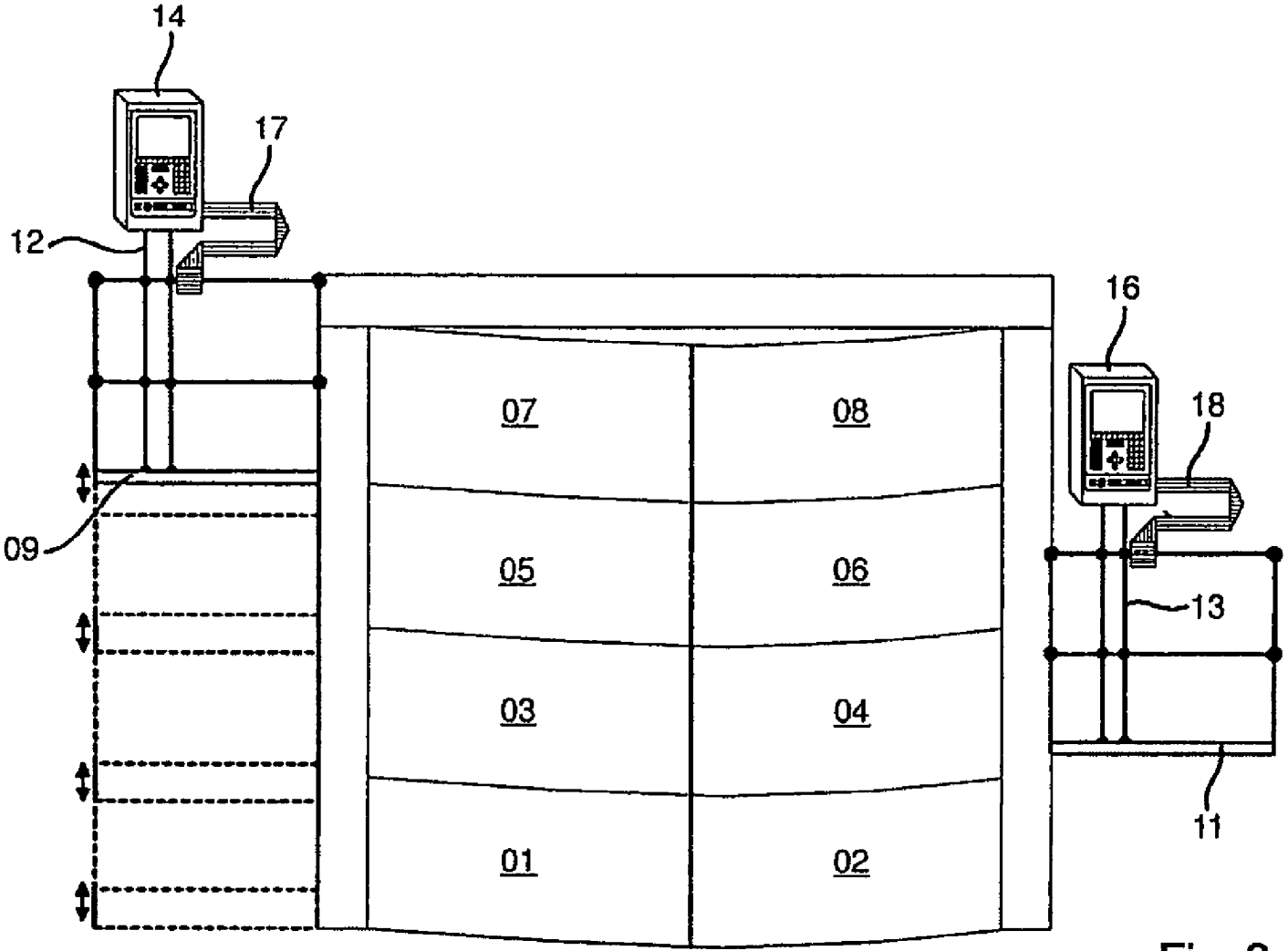

To allow easier access for the press operators to the printing groups 01 to 08, which are arranged on top of each other on either the left side or the right side of the printing press, lifting devices 09 or 11, as seen in FIG. 1 and in FIG. 2 are provided on both sides of the printing press, which lifting devices are embodied in the manner of lifting platforms 09 or 11 and which can be displaced by the use of drive mechanisms, which are not specifically represented in FIGS. 1 and 2. Support devices 12 or 13 are provided on the two lifting devices 09, 11. Operating units 14 or 16, which are adjustable in their positions, have been attached to upper ends of support devices 12 or 13, respectively. By setting the height of the operating units 14, 16, through movement of the support devices 12, 13, the press operators can assume an ergonomically advantageous operating position. The operating units 14 or 16 are each connected by data cables 17 or 18 to a data bus, so that the operating unit 14 can exchange data with the left printing units 01, 03, 05, 07, and the operating unit 16 can exchange information with the right printing units 02, 04, 06, 08.

As can be seen in FIG. 2, the press operators can selectively move the lifting device 09 or 11 to the level of the various printing groups 01 to 08. The actual level of each of the lifting devices 09, 11 is detected by an appropriate sensor device and this information is passed on to the respective one of the operating units 14 or 16. As a function of the measured level of the lifting device 09, 11, the operating units 14, 16 are automatically programmed in such a way that only defined ones of the respective printing groups 01 to 08 can exchange data with the operating units 14 or 16. If, for example, as represented in FIG. 2, the left side lifting device 09 is located at the level of the left side printing group 07, the operating unit 14 supported on that lifting device is programmed in such a way that data can only be exchanged between the operating unit 14 and the printing group 07. A data exchange between the operating unit 14 and all of other printing groups 01, 03, 05 is prevented by the provision of such a position sensor.

If the respective lifting device 09, 11 is not in its highest position but, as shown in FIG. 2, the right lifting device 11 is, for example, positioned at the level of the second-lowest printing group 04, the operating unit 16 associated with lifting device 11 is automatically programmed in such a way that data can only be exchanged either between the operating unit 16 and the printing group 04, or between the operating unit 16 and the printing group 06. In this position of the lifting device 11, a data exchange between the operating unit 16 and the printing groups 02 or 08 is prevented.

Graphic displays and/or run control boards are provided at the operating units 14, 16.

Four printing groups 01, 03, 05, 07, or 02, 04, 06, 08 are arranged on top of each other in the printing tower. Each of the printing groups 01, 03, 05, 07, or 02, 04, 06, 08 has a forme cylinder and a transfer cylinder. Two printing groups 01, 03, 05, 07, or 02, 04, 06, 08 are respectively arranged opposite each other in a bridge-printing manner in the printing tower, again as seen most clearly in FIG. 1.

While a preferred embodiment of a printing tower comprising at least two printing groups, in accordance with the present invention, has been set forth fully and completely hereinabove, it will be apparent to one of skill in the art that various changes in, for example, the specific structure of the printing groups and of the lifting devices can be made without departing from the true spirit and scope of the present invention which is accordingly to be limited only by the appended claims.

What is claimed is:

1. A printing tower comprising:

at least first and second printing groups arranged on top of each other in said printing tower;

a lifting device adapted to position press operators adjacent a selected one of said at least first and second printing groups;

an operating unit adapted to selectively control said at least first and second printing groups by the input of data to said operating unit; and a support device on said lifting device and supporting said operating unit for selective vertical and horizontal position adjustment whereby said at least first and second printing groups can be controlled independently of each other by said operating unit.

2. The printing tower of claim 1 wherein said operating unit is independent of said at least first and second printing groups.

3. The printing tower of claim 1 further including a selector switch on said operating unit and adapted for selecting one of said at least first and second printing groups, said selector switch allowing input of data only to the selected one of said at least first and second printing groups.

4. The printing tower of claim 1 further including connecting cables for each of said at least first and second printing groups, each of said connecting cables being connectable with said operating unit.

5. The printing tower of claim 1 further including a common bus bar adapted to allow said data input to said at least first and second printing groups.

6. The printing tower of claim 1 further including a data interface at each one of said at least first and second printing groups and adapted to transmit said data between said operating unit and said at least first and second printing groups.

7. The printing group of claim 6 wherein said data interface is one of an infra-red and a radio wireless interface.

8. The printing group of claim 6 wherein said interface is a plug-in connector adapted for the receipt of data cables.

9. The printing tower of claim 1 further including a graphic display in said operating unit.

10. The printing tower of claim 1 further including a run control board in said operating unit.

11. The printing tower of claim 1 further including four of said printing groups arranged on top of each other.

12. The printing tower of claim 1 wherein each of said at least first and second printing groups includes a forme cylinder and a transfer cylinder.

13. The printing tower of claim 12 wherein two of said at least first and second printing groups are arranged opposite to each other in a bridge-printing configuration.

14. A printing tower comprising:

at least first and second printing groups arranged on top of each other in said printing tower;

a lifting device adapted to position press operators adjacent a selected one of said at least first and second printing groups;

an operating unit adapted to selectively control said at least first and second printing groups by the input of data to said operating unit;

a support device on said lifting device and supporting said operating unit whereby said at least first and second printing groups can be controlled independently of each other by said operating unit; and a drive mechanism for said lifting device and a sensor in said drive mechanism and adapted to sense a position of said lifting device, selected ones of said at least first and second printing groups being able to exchange said data with said operating unit as a function of a position of said lifting device as sensed by said sensor device, others of said at least first and second printing groups being prevented from exchanging said data.

15. The printing group of claim 14 wherein only said one of said at least first and second printing groups positioned adjacent said lifting device can exchange said data with said operating unit.

16. A printing tower comprising:

at least first and second printing groups arranged on top of each other in said printing tower;

a lifting device adapted to position press operators adjacent a selected one of said at least first and second printing groups;

an operating unit adapted to selectively control said at least first and second printing groups by the input of data to said operating unit;

a support device on said lifting device and supporting said operating unit whereby said at least first and second printing groups can be controlled independently of each other by said operating unit; and redundant operating elements adapted to control defined functions of said at least first and second printing groups and being located both at said operating unit and at said at least first and second printing groups, said redundant operating elements including separate emergency cut-off switches located both at said operating unit and at each of said at least first and second printing groups.

* * * * *